US005194367A

United States Patent [19]

Yamada et al.

[11] Patent Number: 5,194,367

[45] Date of Patent: Mar. 16, 1993

[54] METHOD FOR PROCESSING A SILVER HALIDE PHOTOGRAPHIC MATERIAL

[75] Inventors: Minoru Yamada; Takashi Toyoda; Naoki Arai, all of Kanagawa, Japan

[73] Assignee: Fuji Photo Film Co., Ltd., Kanagawa, Japan

[21] Appl. No.: 384,913

[22] Filed: Jul. 25, 1989

Related U.S. Application Data

[63] Continuation of Ser. No. 125,047, Nov. 25, 1987, abandoned.

[30] Foreign Application Priority Data

Nov. 28, 1986 [JP] Japan ..... 61-281865

[51] Int. Cl.[5] ..... G03C 5/00; G03C 5/31

[52] U.S. Cl. ..... 430/363; 430/399; 430/440; 430/567; 430/621; 430/944

[58] Field of Search ..... 430/440, 567, 944, 399, 430/621, 363

[56] References Cited

U.S. PATENT DOCUMENTS

| | | | |
|---|---|---|---|
| 3,722,019 | 11/1973 | Holden et al. | 430/440 |
| 4,046,571 | 9/1977 | Mertz | 430/399 |
| 4,228,234 | 10/1980 | Okutsu et al. | 430/399 |
| 4,536,473 | 8/1985 | Mihara | 430/575 |
| 4,719,175 | 1/1988 | Chinoporos et al. | 430/440 |

OTHER PUBLICATIONS

Research Disclosure #16139 pp. 26-27, Sep. 1977. "Reversal Processing of Silver Halide Color Photographic Materials".

*Primary Examiner*—Charles L. Bowers, Jr.

*Attorney, Agent, or Firm*—Sughrue, Mion, Zinn, Macpeak & Seas

[57] ABSTRACT

A method for processing a silver halide photographic material for infrared laser scanner is described, comprising developing the silver halide photographic material which comprises a support having thereon at least one hydrophilic colloidal layer including at least one silver halide emulsion layer with an automatic developing machine, wherein the silver halide emulsion layer contains silver chloroiodobromide grains having a silver iodide content of 0 to 2 mol% and a silver chloride content of 0 to 30 mol%, the hydrophilic colloidal layer has a swelling percentage of 200% or less, and as a developing solution for the development step in the automatic developing machine, a single developing solution containing a 3-pyrazolidone developing agent represented by formula (I) is used therein:

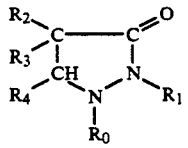

(I)

wherein $R_0$ represents a substituted or unsubstituted aryl group; and $R_1$, $R_2$, $R_3$ and $R_4$, which may be the same or different, each represents a hydrogen atom, a substituted or unsubstituted alkyl group, a substituted or unsubstituted aryl group, or a substituted or unsubstituted aralkyl group, with the proviso that when $R_0$ represents an unsubstituted phenyl group, at least one of $R_1$, $R_2$, $R_3$ and $R_4$ represents a substituted or unsubstituted alkyl group, a substituted or unsubstituted aryl group, or a substituted or unsubstituted aralkyl group.

8 Claims, No Drawings

METHOD FOR PROCESSING A SILVER HALIDE PHOTOGRAPHIC MATERIAL

This is a continuation of application Ser. No. 125,047, filed Nov. 25, 1987, now abandoned.

FIELD OF THE INVENTION

The present invention relates to a method for processing a silver halide photographic material for infrared laser scanner and, more particularly, to a simplified method for processing a silver halide photographic material by means of an automatic developing machine, which does not require complicated preparation of processing solutions.

BACKGROUND OF THE INVENTION

As a method for exposure of a photographic light-sensitive material, an image-forming method due to a so-called scanner process which comprises scanning an original drawing, exposing a silver halide photographic material to light in accordance with the resulting image signal, and then forming a negative or positive image corresponding to the original image has been known heretofore. There are many types of recording devices utilizing such an image-forming method. As recording light sources for these scanning recording devices, a glow lamp, a xenon lamp, a mercury vapor lamp, a tungsten lamp, a light-emitting diode, etc., have heretofore been used. However, these light sources had practical disadvantages in that they have a low output and short life. In order to make up for such disadvantages, there have been developed scanners and laser printers which use a coherent laser source such as a He-Ne laser, an argon laser, or a He-Cd laser as a scanning light source to make exposure at a high intensity of illumination. These scanners and laser printers can produce a high output. However, these scanners and laser printers are disadvantageous in that they are devices of a large size and thereby become expensive, that they need a modulator, and further that the use of visible light restricts the use of safelight for the light-sensitive material, thereby the handling thereof is deteriorated.

In contrast, semiconductor lasers are small and inexpensive. Furthermore, semiconductor lasers can be easily modulated and work longer than the above-described lasers. Furthermore, since the semiconductor lasers emit light in the infrared region, they can use a bright safelight, and thereby the handling thereof is improved. Therefore, the development of a proper light-sensitive material in this field has been gaining in importance in recent years.

On the other hand, silver halide black-and-white photographic materials having been exposed to light are generally processed by steps of development, fixing, and washing or stabilization. When development processing is performed using an automatic developing machine, a replenisher for a developer and a replenisher for a fixer are generally prepared by dissolving the appropriate components constituting each processing solution in water followed by mixing, and the thus-prepared replenisher is reserved in a replenisher tank and fed in a given amount to a developing tank or a fixing tank of the automatic developing machine.

The above-described automatic processing system, including automatic replenishment, is a system established through use for years. However, with the recent development of electronic equipment, the basic system in which silver halide photographic materials are wet processed has been proved to have some disadvantages.

Specifically, the components for each of the developer and fixer are dissolved in water and mixed to prepare a processing solution, and stock tanks for the thus-prepared processing solutions must be provided. Further, although chemical mixers are now widely used, the disadvantage remains that the processing solutions are essentially prepared from several components and extra space is required for a chemical mixer in addition to the space for the automatic developing machine.

In order to make rapid processing possible, an emulsion-hardening reaction is generally performed during processing. However, glutaraldehyde which is usually incorporated in a developer as a hardening agent gives off an irritating smell and also is hazardous in contact with the skin. When hardening is effected by an aluminum salt which is generally used in a fixer, it is necessary to adjust the pH of the fixer to a range of from 4.2 to 4.6, at which the highest hardening reactivity can be attained, in order to suppress swelling with washing water and thereby to lessen the drying load. In this pH range, however, a part of the thiosulfate used as a main component of the fixer decomposes to generate sulfurous acid gas. Also, acetic acid, which is used as a pH buffering agent, produces a gas, thus resulting in contamination of the working environment with unpleasant smells. In some extreme cases, the produced sulfurous acid gas corrodes not only the automatic developing machine but also surrounding equipment through long-term use.

One of the causes of the above-described problems associated with automatic development lies in the hardening reaction during processing, which is usually performed by glutaraldehyde in a developer or an aluminum salt in a fixer. It has previously been known that many of the above problems can be solved by entirely omitting the glutaraldehyde hardening reaction, or by conducting the aluminum salt-hardening reaction, if used, at a pH of 4.65 or higher to reduce its hardening reactivity.

In such a development processing system without a hardening step, it is essential that silver halide photographic materials should be sufficiently hardened in advance. However, if silver halide photographic materials having high sensitivity and high density, such as X-ray films for medical use, are sufficiently hardened beforehand, the required amount of silver coated must be increased, which is unfavorable from the standpoint of conservation of resources and cost.

Therefore, it is a common sense in the art that a higher density is secured by using finely divided grains as much as possible at the cost of photographic sensitivity, i.e., the density per unit amount of silver (covering power) is raised to solve this problem.

Additionally, with the progress of the field of mechatronics, the rapidity in photographic processing combined with such hardware is gaining in importance.

Under these circumstances, it has been keenly desired to sufficiently improve the sensitivity and processing speed in a light-sensitive material processing system for an infrared laser scanner.

In general, a light-sensitive material containing a halide composition having a high chloride concentration can be developed at a higher speed but provides a lower sensitivity. Silver chloride is easily subjected to elution in a developing solution by a sulfite contained therein. This causes precipitation of silver sludge. In order to prevent precipitation of silver sludge, a compound as described in Japanese Patent Application (OPI) No. 24347/81 (the term "OPI" as used herein refers to a "published unexamined Japanese patent application"), U.S. Pat. No. 3,173,789 and British Patent 940,169 may be incorporated into the developing solution. However, the incorporation of such a compound further reduces the sensitivity in the light-sensitive material processing system. That is, this processing system can attain a rapid development and provide a desired gradation but provides low sensitivity.

On the other hand, if the iodide content is high, a high sensitivity can be obtained. However, a high iodide content lowers the development speed and gradation. Therefore, the proportion of iodide is similarly limited.

Furthermore, in order to render to the light-sensitive material a color sensitivity in the near infra-red region, the ratio of the 100 plane to the 111 plane of silver halide grains must be sufficiently high. Also, in order to make this ratio sufficiently high, the proportion of iodide must be limited.

The design of an emulsion for a light-sensitive material having a high sensitivity in the near infrared region is very difficult and thus requires a special technology because this field is new.

SUMMARY OF THE INVENTION

One object of the present invention is to provide higher sensitivity in a system for processing a light-sensitive material for an infrared laser scanner.

Another object of the present invention is to provide rapid development for the formation of images and a smaller automatic developing machine in such a processing system.

Further object of the present invention is to facilitate the preparation of solutions and the maintenance of the automatic developing machine in such a processing system.

Still another object of the present invention is to eliminate offensive odors from the working environment of development and minimize the generation of harmful gas which causes corrosion of nearby machines in such a processing system.

Still further object of the present invention is to enable a complete pipeless processing and to eliminate various restrictions on the site in which such a processing system is installed.

These objects of the present invention have been accomplished by a method for processing a silver halide photographic material for an infrared laser scanner comprising developing the silver halide photographic material which comprises a support having thereon at least one hydrophilic colloidal layer including at least one silver halide emulsion layer with an automatic developing machine, wherein the silver halide emulsion layer contains silver chloroiodobromide grains having a silver iodide content of 0 to 2 mol % and a silver chloride content of 0 to 30 mol %, the hydrophilic colloidal layer has a swelling percentage of 200% or less, and as a developing solution for the development step in the automatic developing machine, a single developing solution containing a 3-pyrazolidone developing agent represented by formula (I) is used therein:

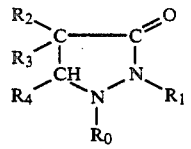

(I)

wherein $R_0$ represents a substituted or unsubstituted aryl group; and $R_1$, $R_2$, $R_3$ and $R_4$, which may be the same or different, each represents a hydrogen atom, a substituted or unsubstituted alkyl group, a substituted or unsubstituted aryl group, or a substituted or unsubstituted aralkyl group, with the proviso that when $R_0$ represents an unsubstituted phenyl group, at least one of $R_1$, $R_2$, $R_3$ and $R_4$ represents a substituted or unsubstituted alkyl group, a substituted or unsubstituted aryl group, or a substituted or unsubstituted aralkyl group.

DETAILED DESCRIPTION OF THE INVENTION

As a result of intensive studies, the inventors have devised a new system which enables attainment of a high sensitivity, a rapid processing, and an easy preparation of solutions by processing a silver halide light-sensitive material for an infrared laser scanner with a highly active developing solution consisting of a single solution (the term "single solution" herein used means "one solution in which several ingredients required are mixed").

The compounds of the present invention are included in those described in British Patents 943,928 and 1,093,281 and U.S. Pat. No. 3,221,023. However, these patents have no description of a method for automatically processing a specific light-sensitive material element of the present invention and thus have no teaching of the constitution and effects of the present invention. The present compounds can find a further technical value and progress, i.e., high sensitivity and simple and rapid processing only when combined with the light-sensitive material processing system of the present invention.

Formula (I) is further described hereinafter.

In formula (I), $R_0$ represents a substituted or unsubstituted aryl group (preferably having 10 or less carbon atoms), e.g., a phenyl group and a naphthyl group.

$R_1$, $R_2$, $R_3$ and $R_4$ each represents a hydrogen atom; a substituted or unsubstituted alkyl group (preferably having from 1 to 4 carbon atoms and particularly preferably from 2 or less carbon atoms), e.g., a methyl group, an ethyl group, a propyl group, an isopropyl group, and higher alkyl group; a substituted or unsubstituted aryl group (preferably having 10 or less carbon atoms), e.g., a phenyl group and a naphthyl group; or a substituted or unsubstituted aralkyl group (preferably having 10 or less carbon atoms), e.g., a benzyl group.

Substituents for these groups include a hydroxyl group, an alkoxy group, a hydroxyalkyl group, an amino group, a nitro group, a sulfo group, a carboxyl group, a halogen atom, etc.

$R_1$ preferably represents a hydrogen atom, an alkyl group substituted with an amino group, or a hydroxyalkyl group. $R_4$ preferably represents a hydrogen atom.

More preferably, $R_2$ represents a hydroxyalkyl group; $R_3$ represents a hydroxyalkyl group or a substituted or unsubstituted alkyl group; and $R_0$ represents a substituted or unsubstituted aryl group.

The alkyl moieties of the above-described alkyl groups preferably have 4 or less carbon atoms.

Specific but nonlimiting examples of the compounds represented by formula (I) are shown below:

1) 1-Phenyl-4,4-dihydroxymethyl-3-pyrazolidone
2) 1-p-Tolyl-4,4-dihydroxymethyl-3-pyrazolidone
3) 1-Phenyl-4-hydroxymethyl-4-methyl-3-pyrazolidone
4) 1-Phenyl-4,4-dimethyl-3-pyrazolidone
5) 1-Phenyl-2-hydroxymethyl-4,4-dimethyl-3-pyrazolidone
6) 1-Phenyl-2-morpholinomethyl-4,4-dimethyl-3-pyrazolidone
7) 1-Phenyl-2-morpholinomethyl-4-methyl-3-pyrazolidone
8) 1-Phenyl-2-hydroxymethyl-4-methyl-3-pyrazolidone
9) 1-Phenyl-5,5-dimethyl-3-pyrazolidone
10) 1-Phenyl-5-methyl-3-pyrazolidone
11) 1-p-Tolyl-4-methyl-4-hydroxymethyl-3-pyrazolidone
12) 1-p-Hydroxyphenyl-4,4-dimethyl-3-pyrazolidone
13) 1-m-Tolyl-4-methyl-4-hydroxymethyl-3-pyrazolidone
14) 1-p-Methoxyphenyl-4-methyl-4-hydroxymethyl-3-pyrazolidone
15) 1-(3,5-Dimethyl)phenyl-4-methyl-4-hydroxymethyl-3-pyrazolidone The compound of the present invention is used in an amount of generally from about 0.1 to 30 g, preferably from about 0.5 to 20 g, and more preferably from about 1 to 15 g, per liter of a developer or a replenishing solution (i.e., a replenisher).

The term "swelling percentage" as used herein means the percent of swelling obtained by comparing (a) the thickness of the hydrophilic colloidal layers measured after incubation of a photographic material at 38° C. and 50% RH for 3 days and (b) the thickness of the hydrophilic colloidal layers measured after dipping the same photographic material in distilled water at 21° C. for 3 minutes. That is, the percent of swelling is shown below.

$$\text{Swelling Percentage (\%)} = \frac{\text{thickness of the layer after dipping} - \text{thickness of the layer after incubation}}{\text{thickness of the layer after incubation}} \times 100$$

From the standpoint of speeding up processing (e.g., reduction of drying load) and simplification of processing (e.g., omission of hardening during processing, and reduction of the number of components of processing solutions), the swelling percentage should not exceed about 200% in the present invention. Speeding up and simplification of processing can be improved with a still lower swelling percentage. On the other hand, too small a swelling percentage unfavorably decreases the rates of development, fixing, washing, etc. Accordingly, the swelling percentage preferably ranges from about 30 to 180%, and more preferably from about 50 to 150%.

It is easy for one skilled in the art to control the swelling percentage below about 200% by, for example, increasing the amount of a hardening agent added to light-sensitive materials. The conventional hardening agents which can be used include various organic compounds, such as aldehyde compounds, active halogen compounds as described in U.S. Patent 3,288,775, compounds having a reactive ethylenically unsaturated group as described in U.S. Patent 3,635,718, halogenocarboxyaldehydes, e.g., mucochloric acid, and the like. Of these, vinylsulfone type hardening agents are preferred. In addition, high molecular hardening agents are also preferably used.

The high molecular hardening agents to be used in this invention preferably include polymers having an active vinyl group or a precursor group thereof. Particularly preferred are those polymers in which such a group is bonded to the main chain thereof via a long spacing group as described in Japanese Patent Application (OPI) No. 142524/81. The amount of these hardening agents to be added varies depending on the kinds of the hardening agent and gelatin used.

In the present invention, it is preferred that the emulsion layers and/or other hydrophilic colloidal layers contain an organic substance capable of being dissolved in the developer solution and running off during development processing. When gelatin is used as such a substance, a gelatin that is not crosslinked by a hardening agent is preferred. Such a gelatin includes acetylated gelatin and phthalated gelatin. The molecular weight of the gelatin is generally 50,000 or less and preferably 20,000 or less. Additional examples of effective substances capable of running off during development processing are polyacrylamides described in U.S. Pat. No. 3,271,158, and other hydrophilic polymers, e.g., polyvinyl alcohol, polyvinyl pyrrolidone, etc. Sugars, e.g., dextran, sucrose, pullulan, etc., are also effective. Among these, polyacrylamide and dextran are preferred, with polyacrylamide being particularly preferred. These substances preferably have an average molecular weight of 20,000 or less, and more preferably 10,000 or less. It is preferred that these substances are lost due to run off during processing in a ratio of from about 10 to 50%, and more preferably from about 15 to 30%, by weight based on the total coverage of organic substances other than silver halide grains.

The aforesaid organic substances capable of running off during processing may be incorporated into either an emulsion layer or a surface protective layer. When the total amount incorporated is predetermined, it is more effective to incorporate these organic substances in both an emulsion layer and a surface protective layer than in an emulsion layer alone. It is most preferred to incorporate them in a protective layer alone. In the case of light-sensitive materials composed of multiple emulsion layers, when the total amount incorporated is predetermined, it is preferred to incorporate these organic substances in higher concentrations in an emulsion layer nearer to a surface protective layer than other emulsion layers.

The light-sensitive silver halide which can be used in the present invention may be a silver halide comprising chlorides, bromides and/or iodides such as silver bromide, silver iodobromide, silver chlorobromide, and silver chloroiodobromide. If the present light-sensitive silver halide is silver iodobromide or silver chloroiodobromide, its silver iodide content is 0 to 2 mol %, preferably 0 to 0.5 mol %, and its silver chloride content is 0 to 30 mol %, preferably 0 to 20 mol %.

It has been found that both the high sensitivity and the rapid processing, which have heretofore been hardly compatible with each other, can be attained at the best balance in a rapid simplified processing method using a single developing solution of the present invention by specifying the halide composition in the above range. Furthermore, the occurrence of silver stain can be effectively inhibited to a practically allowable level. In particular, the present constitution is advantageous in that a surprisingly rapid processing comprising a development time of 15 seconds or less and a dry-to-dry processing time of 60 seconds or less can be attained as described hereinafter.

Furthermore, the ratio of the 100 plane to the 111 plane of the silver halide grain which can be used in the present invention is preferably 3 or more, more preferably 4 or more, and particularly preferably 5 or more. The upper limit of the above ratio is 100% for the 100 plane. If the ratio of the 100 plane to the 111 plane is less than 1, the light-sensitive material significantly loses sensitivity to the near infrared region. Furthermore, if the ratio of the 100 plane to the 111 plane is less than 3, the sensitivity is less desirable. On the contrary, if the ratio is 3 or more, a high sensitivity to the near infrared region can be secured, providing a high sensitivity.

The preparation for the silver halide grain of the present invention having a 100 plane/111 plane ratio of 3 or more can be accomplished by various methods. In the most common method, an aqueous solution of silver nitrate and an aqueous solution of alkali halide are simultaneously added at a higher rate than the particle dissolution rate such that no renucleation occurs while the pAg value during the formation of particles is kept constant below 8.10. (This is a so-called controlled double jet method.) The pAg is maintained preferably at 7.80 or less, and more preferably at 7.60 or less. The formation of the silver halide grain occurs in two stages, i.e., formation of the nucleus and growth of the nucleus. The pAg value during the formation of the nucleus is not limited. The pAg value during the growth of the nucleus is preferably maintained at 8.10 or less, more preferably 7.80 or less, and particularly preferably 7.60 or less. The reaction of the soluble silver salt with the soluble silver halide may be accomplished by a single jet method. However, a double jet method is preferably used in order to provide an excellent monodispersibility.

The silver halide grain which can be used in the present invention comprises a silver halide grain having a 100 plane/111 plane ratio of 3 or more, preferably 4 or more, and more preferably 5 or more, in an amount of generally 50% or more, preferably 60% or more, and particularly preferably 80% or more, by weight.

These emulsions may comprise coarse grains or finely divided grains or a mixture thereof. Preferably, the present emulsion comprises emulsion grains having an average grain diameter of about 0.04 to 1.0 μm, and preferably 0.2 to 0.7 μm, as determined by a projected area process and a number average process.

The grain shape is preferably cubic. However, the grain shape may be an irregular crystal shape such as a pebble-like shape, a spherical shape, or a tabular shape having a grain diameter/grain thickness ratio of 5 or more as described in *Research Disclosure,* Item No. 22534 (pages 20 to 58, January, 1983) so long as it satisfies the face index conditions of the present invention. These light-sensitive emulsions may be mixed with a substantially light-insensitive emulsion (e.g., internally fogged grain emulsion). It goes without saying that emulsions having different grain sizes and halide compositions may be separately coated on different layers in order to enlarge the exposure latitude.

The grain size distribution is preferably narrow so that a "monodispersed" emulsion is provided. Specifically, a monodispersed emulsion having a grain size distribution in which 90% or more of the total grains fall within ±40%, and preferably ±20%, of the average grain size may be preferably used.

The crystal structure of silver halide grains may be uniform, or may have a layer structure having different halide compositions between the inner portion and the outer portion. The silver halide grain of the present invention may be of a conversion type as described in British Patent 635,841 and U.S. Pat. No. 3,622,318. Moreover, the present silver halide grain may be of the surface latent image type in which latent images are formed mainly in the surface thereof or the internal latent image type in which latent images are formed mainly in the interior thereof.

The light-sensitive material of the present invention may contain iridium ions.

In order to incorporate iridium ions in the light-sensitive material, a water-soluble iridium compound (e.g., hexachloroiridium (III) acid salt and hexachloroiridium (IV) acid salt) may be added during the preparation of a silver halide emulsion in the form of an aqueous solution. Such iridium ions may be added in the form of the same aqueous solution as the halide for the formation of grains. Such iridium ions may be added before, during or after the formation of grains. However, such iridium ions are most preferably added during the formation of grains.

In the present invention, such iridium ions are used in an amount of from $1\times10^{-8}$ to $1\times10^{-5}$ mol, preferably from $5\times10^{-7}$ to $5\times10^{-6}$ mol, and particularly preferably from $1\times10^{-7}$ to $1\times10^{-6}$ mol, per mol of silver halide.

If the content of iridium ions is less than $10^{-8}$ mol or less, a further improvement of high intensity sensitivity cannot be attained. On the contrary, if the content of iridium ions is more than $1\times10^{-5}$ mol, a desensitization of the sensitivity in the infrared region is caused.

In the present invention, the addition of a water-soluble iodine compound (e.g., potassium iodide, sodium iodide, and ammonium iodide) can be effected in the middle or latter stage of the formation of grains, before chemical sensitization immediately after desalting, before the addition of an infrared sensitizing dye immediately after chemical sensitization, or before coating immediately after the addition of an infrared sensitizing dye. However, it may be most preferably effected between the latter stage of the formation of grains and before chemical sensitization. Such a soluble iodine compound may be used in an amount of $5\times10^{-5}$ to $2\times10^{-2}$ mol, preferably $2\times10^{-4}$ to $5\times10^{-3}$ mol, and particularly preferably $5\times10^{-4}$ to $3\times10^{-3}$ mol, per mol of silver halide. If the content of water-soluble iodine compound is less than $5\times10^{-5}$ mol, an improvement of preservability cannot be attained. On the contrary, if the content of water-soluble iodine compound is more than $2\times10^{-2}$ mol, the good effect due to the iodine compound is not obtained, and further if the content of water-soluble iodine compound is more than $5\times10^{-2}$ mol, it causes fog, giving soft gradation.

The water-soluble iodine compound which can be used in the present invention does not contain any spectral sensitizing dye.

Such a water-soluble iodine compound may be used in a molar proportion of the water-soluble iodine compound to the infrared sensitizing dye of 2/1 to 100/1, preferably 4/1 to 50/1.

These two components may be added simultaneously or separately.

During the formation of the silver halide grains, any suitable silver halide solvent may be used to control the growth of grains. Examples of such a silver halide solvent include ammonia, potassium thiocyanate, ammonium thiocyanate, thioether compounds as described in U.S. Pat. Nos. 3,271,157, 3,574,628, 3,704,130, 4,297,439 and 4,276,374, thione compounds as described in Japanese Patent Application (OPI) Nos. 144319/78, 82408/78 and 77737/80, and amine compounds as described in Japanese Patent Application No. 100717/79. Besides such silver halide solvents, there may be used a compound which is adsorbed on the surface of grains to control crystal habit, such as a cyanine sensitizing dye, a tetraazaindene compound, and a mercapto compound. These compounds may be used during the formation of the grains.

The 100 plane/111 plane ratio of the grains of the present invention can be determined by Kubelka-Munk's dye adsorption process. Referring to this process, a dye which is preferentially adsorbed by either the 100 plane or the 111 plane and differs spectrally in dye association from the 100 plane to the 111 plane is selected. Such a dye is added to an emulsion. A detailed spectral analysis is conducted with respect to the added amount of such a dye. Thus, the 100 plane/111 plane ratio can be determined.

The accurate proportion of the 100 plane on the surface of silver halide grains can be determined by a method described in *Determination of crystal phase of silver halide grains in photographic emulsion due to dye adsorption phenomenon* (edited by Tadaaki Tani, published by Nippon Kagakukai (Japan Association of Chemistry), Vol. 6, pp. 942–946, 1984).

The silver halide photographic emulsion of the present invention can be subjected to a commonly used chemical sensitization process such as a gold sensitization process as described in U.S. Pat. Nos. 2,540,085 and 2,399,083, a sensitization process with a group VIII metal ion as described in U.S. Pat. Nos. 2,448,060 and 2,598,079, a sulfur sensitization process as described in U.S. Pat. Nos. 1,574,944, 2,278,947, 3,021,215 and 3,635,717, a reduction sensitization process as described in U.S. Pat. No. 2,518,698 and *Research Disclosure*, RD 17643, Vol. 176, Chapter III, (December, 1978), a sensitization process with thioether compounds as described in U.S. Pat. Nos. 2,521,926, 3,021,215, 3,046,133, 3,165,552, 3,625,697, 3,635,717 and 4,198,240, and combinations of these methods.

Specific examples of chemical sensitizers include sulfur sensitizers such as sodium thiosulfate, allyl thiocarbamide, thiourea, thiosulfate, thioether, and cystine, noble metal sensitizers such as potassium chlorooleate, aurous thiosulfate, and potassium chloropalladate, and reduction sensitizers such as stannous chloride, phenylhydrazine and reductone.

In the present invention, as infrared sensitizing dyes there can be preferably used at least one of tricarbocyanine dyes and/or 4-quinoline nucleus-containing dicarbocyanine dyes.

The above-described infrared sensitizing dyes of the present invention are contained in the silver halide photographic emulsion in an amount of from $5\times10^{-7}$ to $5\times10^{-3}$ mol, preferably from $1\times10^{-6}$ to $1\times10^{-3}$ mol, and particularly preferably from $2\times10^{-6}$ to $5\times10^{-4}$ mol, per mol of silver halide.

The above-described infrared sensitizing dyes which can be used in the present invention can be directly dispersed in the emulsion. Alternatively, these dyes can be first dissolved in an appropriate solvent such as methyl alcohol, ethyl alcohol, methyl cellosolve, acetone, water, pyridine, and mixtures thereof, and then added to the emulsion in the form of a solution. The addition of the dyes may be normally effected after the chemical sensitization. It may be effected during the formation of grains or before the chemical sensitization. The dissolution of the dyes in the solvent may be effected by means of ultrasonic waves.

The addition of the dyes to the emulsion can also be accomplished by any methods as described in U.S. Pat. Nos. 2,912,343, 3,342,605, 2,996,287 and 3,429,835. The above-described infrared sensitizing dyes may be uniformly dispersed in the silver halide emulsion before being coated on a proper support. Alternatively, the dyes can be dispersed in the emulsion at any step in the preparation of the silver halide emulsion as previously described.

The present sensitizing dyes can be used in combination with other sensitizing dyes. Examples of such other sensitizing dyes are described in U.S. Pat. Nos. 3,703,377, 2,688,545, 3,397,060, 3,615,635, 3,628,964, 3,416,927, 3,615,613, 3,615,632, 3,617,295 and 3,635,721, British Patents 1,242,588 and 1,293,862, and Japanese Patent Publication Nos. 4936/68, 14030/69, 10773/68 and 4930/68.

In the present invention, a compound for the purpose of further improving the super-sensitization effect and/or preservability can be used together with the above-described sensitizing dye.

In the present invention, a preservability improver for light-sensitive materials can be used in combination with the above-described sensitizing dye in an amount of about 0.01 to 5 g per mol of silver halide in the emulsion.

The weight ratio of the above-described infra-red sensitizing dye to the above-described light-sensitive material preservability improver is preferably 1/1 to 1/300, and particularly preferably 1/2 to 1/50.

The above-described supersensitizing dye or light-sensitive material preservability improver which can be used in the present invention may be directly dispersed in the emulsion. Alternatively, the super-sensitizing dye or light-sensitive material preservability improver may be first dissolved in a proper solvent such as water, methyl alcohol, ethyl alcohol, propanol, methyl cellosolve, and acetone, or a mixed solvent comprising such solvents, and then added to the emulsion. Furthermore, the supersensitizing dye or light-sensitive material preservability improver may be added to the emulsion in the form of a solution or a dispersion in a colloid in accordance with a method of addition of sensitizing dyes.

The above-described infrared sensitizing dye and light-sensitive material preservability improver may be added to the emulsion before or after the addition of the previously-described infrared sensitizing dye. The infrared sensitizing dye and the light-sensitive material preservability improver may be separately dissolved in solvents. The two solutions may then be simultaneously added to the emulsion separately or in admixture.

As suitable antihalation dyes and/or antiirradiation dyes for the present invention, dyes having a substantial absorption in a long wavelength band of 750 nm or higher can be used. Such an antihalation dye is used in an interlayer, a subbing layer, an antihalation layer, a backing layer, an emulsion layer, or the like. Such an antiirradiation dye is used in an emulsion layer, an interlayer, or the like. These dyes can be used in an amount of from $1\times10^{-3}$ to 1 g/m$^2$ and preferably from $1\times10^{-3}$ to 0.5 g/m$^2$ For example, dyes as described in U.S. Pat. Nos. 2,895,955, 3,177,078 and 4,581,325, and Japanese Patent Application (OPI) No. 100116/75 may be preferably used in the present invention.

These dyes may be used singly or in combination.

Alternatively, other dyes can be used singly or in combination with the above-described dyes. Examples of such other dyes include pyrazoloneoxonol dyes as described in U.S. Pat. No. 2,274,782, diarylazo dyes as described in U.S. Pat. No. 2,956,879, styryl dyes and butadienyl dyes as described in U.S. Pat. Nos. 3,423,207 and 3,384,487, merocyanine dyes as described in U.S. Pat. No. 2,527,583, merocyanine dyes and oxonol dyes as described in U.S. Pat. Nos. 3,486,897, 3,652,284 and 3,718,472, and enaminohemioxonol dyes as described in U.S. Pat. No. 3,976,661.

The photographic light-sensitive material of the present invention may comprise various compounds in order to prevent reduction of sensitivity or generation of fog during the preparation, preservation or processing thereof. As such various compounds there have heretofore been known an extremely large number of compounds such as nitrobenzimidazole, ammonium chloroplatinate, 4-hydroxy-6-methyl-1,3,3a,7-tetraazaindene, 1-phenyl-5-mercaptotetrazole, and other various heterocyclic compounds, mercury-containing compounds, mercapto compounds, and metal salts. An example of such compounds which can be used in the present invention is described with its original references in C. E. K. Mees, *The Theory of the Photographic Process,* 3rd Edition, pp. 344–349, 1966. Examples of such compounds include thiazolium salts as described in U.S. Pat. Nos. 2,131,038 and 2,694,716, azaindenes as described in U.S. Pat. Nos. 2,886,437 and 2,444,605, urazoles as described in U.S. Pat. No. 3,287,135, sulfocatechols as described in U.S. Pat. No. 3,236,652, oximes as described in British Patent 623,448, mercaptotetrazoles and nitron as described in U.S. Pat. Nos. 2,403,927, 3,266,897 and 3,397,987, nitroindazoles, polyvalent metal salts as described in U.S. Pat. No. 2,839,405, thiuronium salts as described in U.S. Pat. No. 3,220,839, and palladium, platinum and gold salts as described in U.S. Pat. Nos. 2,566,263 and 2,597,915.

In the present invention, as matting agents there can be used homopolymers of polymethyl methacrylate or polymers of methyl methacrylate and methacrylic acid as described in U.S. Pat. Nos. 2,992,101, 2,701,245, 4,142,894 and 4,396,706; organic compounds such as starch; or finely divided particles of inorganic compounds such as silica, titanium dioxide, strontium-barium sulfate. The particle size of such particulate compounds is preferably from 1.0 to 10 μm and particularly preferably from 2 to 5 μm.

The surface layer of the present photographic light-sensitive material may comprise a silicone compound as described in U.S. Pat. Nos. 3,489,576 and 4,047,958, a colloidal silica as described in Japanese Patent Publication No. 23139/81, a paraffin wax, a higher aliphatic ester, a starch derivative, or the like as a lubricant.

The hydrophilic colloidal layer of the present photographic light-sensitive material may comprise as a plasticizer a polyol such as trimethylolpropane, pentadiol, butanediol, ethylene glycol, and glycerin.

Furthermore, the hydrophilic colloidal layer of the present photographic light-sensitive material may preferably comprise a polymer latex for the purpose of improving the pressure resistance thereof. As such polymers there can be preferably used homopolymers of acrylic alkylester or copolymers of acrylic alkylester with acrylic acid, styrene-butadiene copolymers, or polymers or copolymers containing active methylene groups.

The silver halide photographic light-sensitive material of the present invention may comprise light-insensitive layers such as surface protective layers, interlayers, and antihalation layers besides the light-sensitive silver halide emulsion layer.

The silver halide emulsion layer may consist of two or more layers. In this case, the two or more silver halide emulsion layers may have different sensitivities and gradations. Furthermore, the support may comprise one or more silver halide emulsion layers or light-insensitive layers on both sides thereof.

The photographic emulsion layer or other hydrophilic colloid layer of the light-sensitive material prepared in accordance with the present invention may contain various surface active agents for various purposes, for example, as coating aid, as antistatic agents, for improvement of sliding properties, as emulsification and dispersing aids, for prevention of adhesion, or for improvement of photographic properties such as acceleration of development, increase in contrast, and increase in sensitivity.

As suitable antistatic agents for the present invention there can be preferably used fluorine-containing surface active agents or polymers as described in U.S. Pat. No. 4,201,586, Japanese Patent Application (OPI) Nos. 80849/85, 215272/87, 9044/87 and 74554/84, nonionic surface active agents as described in Japanese Patent Application (OPI) Nos. 76742/85, 80846/85, 80848/85, 80839/85, 76741/85, 208743/83, 172343/87, 173456/87 and 215272/87, or electrically conductive nonionic, anionic, cationic or amphoteric polymers or latexes as described in Japanese Patent Application (OPI) Nos. 204540/82 and 2152~2/87. As inorganic antistatic agents there may be preferably used electrically conductive tin oxide, zinc oxide, or composite oxides comprising such a metal oxide doped with antimony as described in Japanese Patent Application (OPI) No. 118242/82.

The silver halide photographic emulsion layer or interlayer to be used in the present invention may comprise gelatin as a protective colloid. Other compounds which can be used as protective colloids include acylated gelatin such as phthalated gelatin, and malonated gelatin; cellulose compounds such as hydroxyethyl cellulose, and carboxymethyl cellulose; soluble starch such as dextrin, and hydrophilic polymers such as polyvinyl alcohol, polyvinyl pyrrolidone, polyacrylamide, and polystyrenesulfonic acid. Particularly, gelatin can be preferably used in combination with dextrin and polyacrylamide.

The present photographic light-sensitive material may further comprise a polymer latex made of a homopolymer or copolymer of alkyl acrylate, alkyl methacrylate, acrylic acid, glycidyl acrylate or the like as described in U.S. Pat. Nos. 3,411,911, 3,411,912, 3,142,568, 3,325,286 and 3,547,650, and Japanese Patent Publication No. 5331/70 for the purpose of improving the dimensional stability thereof or film properties.

The photographic emulsion layer or other hydrophilic colloidal layers of the light-sensitive materail prepared according to the present invention may comprise a plasticizer, a fluorescent brightening agent, an air fog inhibitor, a color toner, or the like.

As suitable supports for the present invention there can be preferably used a polyethylene terephthalate film or a cellulose triacetate film. Such a film is preferably colored blue.

The present support may be preferably subjected to corona discharge treatment, glow discharge treatment, or ultraviolet irradiation treatment in order to improve the adhesion thereof to the hydrophilic colloidal layer. The present support may be provided with a subbing layer made of a styrene-butadiene latex, vinylidene chloride latex or the like. The present support may be further provided with a gelatin layer on the subbing layer.

Alternatively, the present support may be provided with a subbing layer comprising an organic solvent containing a polyethylene lubricant and gelatin.

As a light source for imagewise exposure there can be used any one of various known sources of light containing infrared rays such as a tungsten lamp, a cathode ray tube flying spot, a light-emitting diode, and a laser (e.g., a gas laser, a YAG laser, a dye laser, and a semiconductor laser). The exposure time generally is in the range of from $1/10^5$ to $1/10^8$ second. The spectral composition of the light to be used for exposure can be adjusted by a color filter as necessary. The present light-sensitive material is particularly adapted for use in a scanner using a semiconductor laser.

As a developing agent for the black-and-white developing solution to be used in the present invention there can be most preferably used a combination of a dihydroxybenzene and a 1-phenyl-3-pyrazolidone of the present invention because it can easily provide excellent properties. It goes without saying that the developing solution of the present invention may further contain a p-aminophenolic developing agent.

Specific examples of the dihydroxybenzene developing agents used in combination with the compounds of the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., with hydroquinone being particularly preferred.

Specific examples of the p-aminophenol developing agents used in combination with compounds of the present invention include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, etc., with N-methyl-p-aminophenol being preferred.

These developing agents are typically used in a total amount of from about 0.01 to 1.2 mol per liter of the developer or developer replenisher.

The developer can further contain a sulfite preservative, such as sodium sulfite, potassium sulfite, lithium sulfite, ammonium sulfite, sodium bisulfite, potassium metabisulfite, sodium formaldehyde bisulfite, etc. Such a sulfite is preferably added in an amount of at least about 0.2 mol/liter, and more preferably from about 0.4 to 2.5 mol/liter.

The developer preferably has a pH of from about 9 to 13, and more preferably from about 10 to 12. Alkali agents used for pH adjustment include sodium hydroxide, potassium hydroxide, sodium carbonate, potassium carbonate, sodium tertiary phosphate, potassium tertiary phosphate, and the like. pH adjustment may also be effected by buffering agents, such as borates described in Japanese Patent Application (OPI) No. 186259/87, sucrose, acetoxime or 5-sulfosalicylic acid as described in Japanese Patent Application (OPI) No. 93433/85, phosphates, and carbonates.

The developer can furthermore contain other conventional additives, such as development inhibitors, e.g., sodium bromide, potassium bromide, and potassium iodide; organic solvents, e.g., ethylene glycol, diethylene glycol, triethylene glycol, dimethylformamide, methyl cellosolve, hexylene glycol, ethanol, and methanol; and antifoggants, such as mercapto compounds (e.g., 1-phenyl-5-mercaptotetrazole, sodium 2-mercaptobenzimidazole-5-sulfonate, etc.), indazoles (e.g., 5-nitroindazole, etc.), and benzotriazoles (e.g., 5-methylbenzotriazole, etc.). Other additives which can be incorporated into a developer, if desired, include color toners, surface active agents, defoaming agents, hard water softening agents, and amino compounds described in Japanese Patent Application (OPI) No. 106244/81.

The developer can additionally contain silver stain inhibitors, such as those described in Japanese Patent Application (OPI) No. 24347/81. Further, amino compounds, such as alkanolamines as described in Japanese Patent Application (OPI) No. 10624/81, may also be added to the developer.

In addition, other compounds described in L. F. A. Mason, Photographic Processing Chemistry, pp. 226 to 229 (Focal Press, 1966), U.S. Pat. Nos. 2,193,015 and 2,592,364, and Japanese Patent Application (OPI) No. 64933/73 may also be added to the developer.

As described previously, conventional processing solutions are obtained by adding several components separated (containing several ingredients) at the period of use in order to avoid deterioration or any change of the ingredients caused by a reaction among them during the period from preparation of each component, through preparation of processing solutions, and up to use of the processing solutions. The processing solution for use is usually prepared by successively dissolving each component in previously prepared water, mixing the solution, and finally diluting to a given volume with water. Each of the components constituting a processing solution is generally a concentrate of the processing solution for use.

When light-sensitive materials are processed in an automatic developing machine, the developer concentrate is generally replenished together with water for dilution. On this occasion, it is preferred that the developer concentrate contain the smallest possible number of components (preferably, a single component (the term "a single component" as used herein means "a single solution" which is storage stable, containing many ingredients to be used for development)) in the present invention in view of simplicity of the machine and replenishment accuracy. If the concentrate is composed of two or more components (solutions) which should be successively diluted with water as in the conventional system, extra pumps and tanks are required, and the packing material is designed as to keep each of the components apart until use, thus complicating both the replenishment operation and the automatic developing machine.

The term "development time" and "fixing time" as hereinafter used mean the time from dipping of light-sensitive materials in a developing solution up to dipping in a fixer, and the time from dipping in a fixer up to dipping in a washing solution (or stabilizing bath), respectively. The term "washing time" as hereinafter used means the time for dipping in a washing solution. The term "drying time" as hereinafter used means the time during which the light-sensitive materials are placed in a drying zone of an automatic developing machine, wherein hot air usually of from 35° C. to 100° C., and preferably of from 40° C. to 80° C., is introduced.

The development temperature and time are preferably from about 25° C. to about 50° C. and from about 6 seconds to 2 minutes, more preferably from about 30° C. to 40° C. and from about 6 to 30 seconds, and most preferably from about 30° C. to 40° C. and from about 6 to 15 seconds.

A fixer (containing fixer replenisher) is a solution containing a thiosulfate, etc., and having a pH of about 3.8 or higher, preferably from about 4.2 to 5.5, and more preferably from about 4.65 to 5.5. Fixing agents to be used include sodium thiosulfate and ammonium thiosulfate and advantageously contain a thiosulfate ion and an ammonium ion. From the standpoint of the fixing rate, ammonium thiosulfate is particularly preferred. The amount of the fixing agent to be used is subject to variation and usually ranges from about 0.1 to about 6 mol/liter.

The fixer may contain, as a hardening agent, a water-soluble aluminum salt, e.g., aluminum chloride, aluminum sulfate, potassium alum, etc.

The fixer can contain tartaric acid or derivatives thereof, or citric acid or derivatives thereof either alone or in combinations thereof. These compounds are effective when added in an amount of at least about 0.005 mol/liter, and particularly from about 0.01 to 0.03 mol/liter. Specific examples of the tartaric or citric acid derivatives include potassium tartrate, sodium tartrate, potassium sodium tartrate, sodium citrate, potassium citrate, lithium citrate, and ammonium citrate.

If desired, the fixer can further contain a preservative (e.g., sulfites and bisulfites), a pH buffering agent (e.g., acetic acid and boric acid), a pH adjuster (e.g., sulfuric acid), a chelating agent capable of softening hard water, or the compound described in Japanese Patent Application (OPI) No. 78551/87.

The fixing temperature and time are similar to those for development, and fixing is preferably carried out at a temperature of from about 20° C. to about 50° C. for a period of from about 6 seconds to 2 minutes, more preferably at a temperature of from about 30° C. to 40° C. for a period of from about 6 seconds to 30 seconds, and most preferably at a temperature of from about 30° C. to 40° C. for a period of from about 6 to 15 seconds.

A fixing tank is replenished with a concentrate of a fixer together with water for dilution as light-sensitive materials are processed by an automatic developing machine. It is desirable that the fixer concentrate used in the present invention be a single component replenisher (the term "a single component" as used herein means "a single solution" which is storage stable, containing many ingredients to be used for fixing) for the same reasons previously explained with respect to replenishment of a developer.

The pH value at which a fixer concentrate containing single component (single solution) can stably exist is about 4.5 or higher, and preferably about 4.65 or higher. If it is less than about 4.5, the thiosulfate present in the solution decomposes into a sulfide compound with the passage of time, particularly when left to stand for years before use. At a pH of about 4.5 or higher, generation of sulfur dioxide gas is suppressed, thereby keeping the working environment in good conditions. Although the upper limit of the pH range is not critical, if fixing is effected at too high a pH, the film pH remains high even after subsequent washing, causing large swelling of the film which increases the drying load. Accordingly, the upper limit of pH for fixing is generally about 7. In the case of using a fixer containing an aluminum salt for film hardening, a pH of about 5.5 is the upper limit from the standpoint of prevention of precipitation of the aluminum salt.

In the processing system according to the present invention, either one of a developer and a fixer may be a solution having a concentration suitable for running operation so that it may be supplied as it is without requiring dilution with water.

The amount of a developer or fixer concentrate supplied to a processing tank and the mixing ratio of the concentrate with diluting water depend on the composition of the concentrate. In general, the ratio of concentrate/water for dilution is from 1/0 to 1/10, preferably from 1/0 to 1/8, and particularly preferably from 1/1 to 1/5, and the amount of the developer and the fixer replenisher added preferably ranges from about 50 to 1,500 ml per $m^2$ of light-sensitive materials processed, respectively.

The light-sensitive materials after development and fixing are generally subjected to washing or stabilization. The washing or stabilization can be carried out in accordance with any conventional techniques known in the art. The washing water or stabilizer used may contain various known additives. For example, use of water subjected to fungus-proofing treatment in the washing or stabilization not only makes it possible to achieve an appreciable saving of water, reducing the required amount of replenishing water to 3 liters or less per $m^2$ of light-sensitive materials, but also eliminates the necessity of piping for installing an automatic developing machine and, at the same time, decreases the number of the stock tanks needed. In other words, both diluting water for preparation of a developer and a fixer and water for washing or stabilization can be fed from the same stock tank, thus reducing the size of an automatic developing machine.

More specifically, since formation of fur (i.e., undesirable slime), etc., can be prevented effectively by using fungus-proofed water in the washing water or stabilizer, the amount of replenishing water can be reduced to a range of from 0 up to about 3 liters, and preferably from 0 to about 1 liter, per $m^2$ of light-sensitive materials.

When the amount of replenishing water is 0 liter, no replenishment is conducted, except for occasional replacement of the loss of water in a bath due to spontaneous evaporation and the like, that is, washing or stabilization is carried out substantially without replenishment.

A multistage countercurrent system using, for example, 2 or 3 stages, is conventionally known as a technique for decreasing the replenishing water. Application of the multistage countercurrent system to the present invention further increases washing efficiency because the light-sensitive material after fixing contacts water becoming cleaner as it proceeds to the next stage. According to this system, unstable thiosulfates and the like can be removed appropriately from the light-sensitive material, and subsequent discoloration of images is diminished to produce markedly improved stabilizing effects. In addition, this system permits a very great saving of washing water.

When the photographic processing according to the present invention is carried out with a small quantity of washing water, it is preferred to use a washing system provided with a squeegee roller described in Japanese Patent Application (OPI) No. 32460/87.

A part or the whole of the overflow from a washing or stabilizing bath resulting from replenishment with fungus-proofed water may be used as a part of a processing solution having fixing capability in the step preceding the washing or stabilization step, whereby stock water can be saved and waste water reduced in quantity.

Means of fungus-proofing include ultraviolet irradiation as described in Japanese Patent Application (OPI) No. 263939/85, application of a magnetic field as described in Japanese Patent Application (OPI) No. 26394/85, purification of water by the use of an ion exchange resin as described in Japanese Patent Application (OPI) No. 131632/86, and treatment with microbiocides as described in Japanese Patent Application (OPI) Nos. 115154/87, 153952/87 and 289532/87.

Further, germicides, fungicides, surface active agents or similar agents as described, e.g., in L. E. West, Water Quality Criteria, *Photo. Sci. & Eng., Vol.* 9, No. 6 (1965), M. W. Beach, Microbiological Growths in Motion-Picture Processing, *SMPTE Journal,* Vol. 85 (1976), R. O. Deegan, Photo Processing Wash Water Biocides, *J. Imaging Tech.,* Vol. 10, No. 6 (1984), and Japanese Patent Application (OPI) Nos. 8542/82, 58143/82, 105145/83, 132146/82, 18631/83, 97530/82 and 157244/82 can also be used alone or in combination.

In addition, the washing bath may contain, alone or in combination, microbiocides, such as the isothiazoline compounds described in *Research Disclosure,* Vol. 205, RD 20526 (May, 1981), the isothiazoline compounds described in ibid., Vol. 228, RD 22845 (April, 1983), and the compound described in Japanese Patent Application (OPI) No. 289532/87.

Specific examples of fungicides are phenol, 4-chlorophenol, pentachlorophenol, cresol, o-phenylphenol, chlorophene, dichlorophene, formaldehyde, glutaraldehyde, chloroacetamide, p-hydroxybenzoic esters, 2-(4-thiazolyl)benzimidazole, benzisothiazolin-3-one, dodecylbenzyldimethylammonium chloride, N-(fluorodichloromethylthio)phthalimide, and 2,4,4'-trichloro-2'-hydroxydiphenyl ether.

The washing water may also contain the chemicals described in Hiroshi Horiguchi, *Bokin-Bobai no Kagaku,* (Sankyo Shuppan, 1982) and Nihon Bokin-Bobai Gakkai (ed.), *Bokin-Bobai Gijutsu Handbook,* (Gihodo, 1986).

In view of space for equipment, water subjected to fungus-proofing treatment and preserved in a stock tank is preferably utilized both as diluting water for processing solutions, e.g., a developer and a fixer, and as washing water. It is also possible for the fungus-proofed water used as diluting water and that used for washing water (or stabilizer) to be stocked in separate tanks. Tap water also may be utilized for either of diluting water and washing water.

When fungus-proofed water is separately provided for different uses, various additives can be added to the washing water (or stabilizer). For example, chelating compounds having a chelate stability constant (log K) with aluminum of about 10 or more may be added. These compounds are effective to prevent formation of a white precipitate when a fixer contains an aluminum compound as a hardening agent.

Specific examples of such chelating compounds are ethylenediaminetetraacetic acid (log K=16.1), cyclohexanediaminetetraacetic acid (log K=17.6), diaminopropanoltetraacetic acid (log K=13.8), diethylenetriaminepentaacetic acid (log K=18.4) or triethylenetetraminehexaacetic acid (log K=19.7) and sodium, potassium or ammonium salts thereof. These chelating compounds are preferably added in an amount of from about 0.01 to 10 g/liter, and more preferably from about 0 1 to 5 g/liter.

The washing water can further contain a silver image stabilizer, such as those described in Japanese Patent Application (OPI) Nos. 434542/83, 114035/83 and 83534/86.

The washing water can furthermore contain a wide variety of surface active agents for the purpose of preventing uneven formation of water drops. Any of cationic, anionic, nonionic, and amphoteric surface active agents may be used for this purpose. Specific examples of useful surface active agents are those described in *Kaimen Kasseizai Handbook,* Kogaku Tosho.

Also, various additives can be added to the stabilizer. Typical additives for the stabilizer include various buffers for adjustment to a pH of, e.g., about 3 to 8, such as borates, metaborates, borax, phosphates, carbonates, potassium hydroxide, sodium hydroxide, aqueous ammonia, monocarboxylic acids, dicarboxylic acids, polycarboxylic acids, and combinations thereof, and aldehydes, such as formalin. In addition, chelating agents, germicides (e.g., thiazoles, isothiazoles, halogenated phenols, sulfanilamide, benzotriazole, etc.), surface active agents, fluorescent brightening agents, hardening agents, and the like may also be used. Two or more of these compounds either for the same purpose or for different purposes may be used in combination.

It is preferred for improvement of image preservability that to adjust film pH after processing, various ammonium salts, e.g., ammonium chloride, ammonium nitrate, ammonium sulfite, ammonium thiosulfate, etc., are further contained to the stabilizer.

The above-described washing or stabilization is preferably performed at a temperature of from 0° C. to about 50° C. for a period of from about 6 seconds to 2 minutes, more preferably at a temperature of from about 15° C. to 40° C. for a period of from about 6 to 30 seconds, and most preferably at a temperature of from about 15° C. to 40° C. for a period of from about 6 to 15 seconds.

The thus-processed photographic materials are then advantageously squeezed by means of a squeezee roller to remove excess water and then dried at a temperature of from about 40° C. to about 100° C. The drying time varies appropriately depending upon conditions and usually ranges from about 5 seconds to 1 minute, and preferably from about 5 to 30 seconds at a drying temperature of from about 40° C. to 80° C.

The dry-to-dry time (i.e., the time required from the beginning of development to the end of drying) according to the present invention can be controlled generally within about 3 minutes and a half, preferably within about 100 seconds, and more preferably within about 60 seconds. For the processing of the light-sensitive material for an infrared laser scanner of the present invention, the development time is most preferably 15 seconds or less, and the dry-to-dry time is most preferably 60 seconds or less. In addition to the reduction in processing time, the present invention permits both simplification of preparation of processing solutions and simplification of maintenance of an automatic developing machine, due to the single component replenisher of a developer and fixer (the term "a single component" as used herein means "a single solution" which is storage stable, containing many ingredients).

The term "dry-to-dry time" as used herein means the time period between the introduction of an edge of a light-sensitive material into an inlet of an automatic developing machine and the discharge of the same edge from the machine.

The present invention will now be illustrated in greater detail by way of the following examples, but the present invention is not to be construed as being limited thereto. Unless otherwise indicated, all parts, percents and ratios are by weight.

EXAMPLE 1

(1) Preparation of Monodispersion Silver Halide Emulsion of the Present Invention An ammonia was placed in a container containing a mixture of gelatin, potassium bromide, and water which had been heated to a temperature of 55° C. An aqueous solution of silver nitrate and an aqueous solution of potassium bromide which had been prepared by addition of a hexachloroiridium (III) acid salt in such a manner that the molar proportion of iridium to silver was $1\times10^{-7}$ mol were added to the content of the reaction container by a double jet method while the pAg of the latter was maintained at 7.60 so that a monodispersion emulsion of silver bromide grain having an average grain size of 0.55 μm was prepared. 98% of the total grains fell within 40% of the average grain size. Potassium iodide was added to the reaction system during the latter period of the formation of grains in an amount of $1\times10^{-3}$ mol per mol of silver. This emulsion was then desalted. The pH value and pAg value of the obtained emulsion were adjusted to 6.2 and 8.6, respectively. The emulsion was then subjected to gold and sulfur sensitization by sodium thiosulfate and chloroauric acid to obtain desired photographic properties. The ratio of the 100 plane to the 111 plane of the emulsion was measured by the Kubelka-Munk's process and was found to be 93/7. This emulsion was designated Emulsion A.

An extremely small amount of thioether was placed in a container containing a mixture of gelatin, sodium chloride, and water which had been heated to a temperature of 70° C. An aqueous solution of silver nitrate and an aqueous solution of a mixture of potassium bromide and sodium chloride (molar proportion of potassium bromide to sodium chloride was 80/20) in the equimolar were simultaneously added by a double jet method to the reaction system so that a monodispersion emulsion of silver halide grain having an average grain size of 0.52 μm was prepared. In this case also, iridium ions (trivalent) were added to the aqueous solution of silver halide in such a manner that the molar proportion to silver was $10^{-7}$ mol. Potassium iodide was added to the reaction system during the latter srage of the formation of grains in an amount of $10^{-3}$ mol per mol of silver. The ratio of the 100 plane to the 111 plane was 95/5. The emulsion particles were subjected to desalting and optimum chemical sensitization as used in Emulsion A to obtain Emulsion B. Furthermore, ammonia was put into a container containing a mixture of potassium bromide and water which had been heated to a temperature of 60° C. An aqueous solution of silver nitrate and a hexachloroiridium (III) acid salt in a molar proportion of iridium to silver of $10^{-7}$ mol were added to the admixture while the pAg of the latter was maintained at 7.60. An aqueous solution having a molar ratio of potassium bromide to potassium iodide of 98/2 was added to the admixture by a double jet method. Potassium iodide was added to the system in a molar proportion to silver of $10^{-3}$ mol during the latter stage of the formation of grains. As a result, a monodispersion silver iodobromide emulsion having an average grain size of 0.5 μm and 100 plane/111 plane ratio of 91/9 which had been subjected to optimum chemical sensitization was obtained. This emulsion was designated Emulsion C.

An emulsion was prepared in the same manner as used in Emulsion A except that the formation of grains was effected at a pAg value of 8.10. As a result, an emulsion having an average grain size of 0.53 μm and 100 plane/111 plane ratio of 70/30 was obtained. This emulsion was designated Emulsion D.

(2) Preparation of Comparative Silver Halide Emulsion

An emulsion was prepared in the same manner as was Emulsion B except that the molar ratio of potassium bromide to potassium chloride was 30/70. As a result, an emulsion having an average grain size of 0.54 μm and 100 plane/111 plane ratio of 97/3 was obtained. This emulsion was designated Emulsion E.

(3) Preparation of Emulsion Coating Solution 1 kg of Emulsions A to E were each measured out. Containers containing these emulsions were each heated to a temperature of 40° C. so that these emulsions were dissolved. 70 cc of a methanol solution of the infrared sensitizing dye described below ($9\times10^{-4}$ mol/liter), 90 cc of an aqueous solution of the supersensitizing agent described below ($4.4\times10^{-3}$ mol/liter), 35 cc of a methanol solution of the light-sensitive material preservability improver described below ($2.8\times10^{-2}$ mol/liter), an aqueous solution of 4-hydroxy-6-methyl-1,3,3a,7-tetraazaindene, an aqueous solution of a dodecylbenzenesulfonate as a coating aid, and an aqueous solution of a polypotassium-p-vinyl-benzenesulfonate compound as a thickener were then added to these emulsions to prepare emulsion coating solutions.

Infrared Sensitizing Dye:

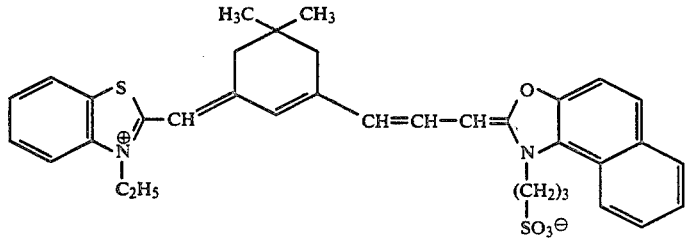

Supersensitizing Agent:

Disodium 4,4'-bis[4,6-di(naphthyl-2-oxy)pyrimidine-2-ylamino]stilbene-2,2-disulfonate Light-Sensitive Material Preservability Improver:

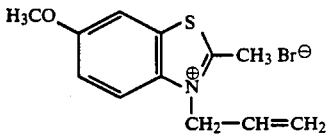

(4) Preparation of Coating Solution for Surface Protective Layer for Light-Sensitive Layer An aqueous solution of sodium polyethylene-sulfonate as a thickener, finely divided particles of polymethyl methacrylate having an average particle size of 3.0 μm as a matting agent, N,N'-ethylenebis(vinylsulfonylacetamide) as a film hardener, an aqueous solution of sodium t-octylphenoxyethoxyethanesulfonate as a coating aid, an aqueous solution of a polyethylene surface active agent as an antistatic agent, and an aqueous solution of a fluorine-containing compound having the structure illustrated below were added to a 10 wt % aqueous solution of gelatin which had been heated to a temperature of 40° C. so that a coating solution was prepared.

$C_8F_{17}SO_2N(C_3H_7)CH_2COOK$ and $C_8F_{17}SO_2N(C_3H_7)(CH_2CH_2O)_{15}H$ (5) Preparation of Back Coating Solution An aqueous solution of sodium polyethylene-sulfonate as a thickener, 50 cc of an aqueous solution of the back dye illustrated below ($5\times10^{-2}$ mol/liter), an aqueous solution of N,N'-ethylenebis(vinylsulfonylacetamide) as a film hardener, and an aqueous solution of sodium t-octylphenoxyethoxyethanesulfonate as a coating aid were added to 1 kg of a 10 wt % aqueous solution of gelatin which had been heated to a temperature of 40° C. so that a back coating solution was prepared.

Back Dye:

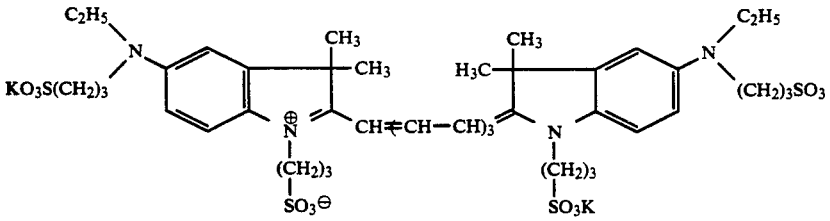

(6) Preparation of Coating Solution for Surface Protective Layer for Backing Layer An aqueous solution of sodium polyethylene-sulfonate as a thickener, finely divided particles of polymethyl methacrylate (average particle size: 3.0 μm) as a matting agent, an aqueous solution of sodium t-octylphenoxyethoxyethanesulfonate as a coating aid, and an aqueous solution of a polyethylene surface active agent and an aqueous solution of a fluorine-containing compound having the structure illustrated below as antistatic agents were added to a 10 wt % aqueous solution of gelatin which had been heated to a temperature of 40° C.

$C_8F_{17}SO_2N(C_3H_7)CH_2COOK$ and $C_8F_{17}SO_2N(C_3H_7)(CH_2CH_2O)_{15}H$ (7) Preparation of Coated Samples The above-described backing layer coating solution was coated together with the coating solution for backing layer surface protective layer on one side of a polyethylene terephthalate support in an amount of 4 g/m$^2$ in terms of the coated amount of gelatin. The emulsion coating solution containing a near infrared sensitizing dye described in (3) and a surface protective layer coating solution for the above coating solution were coated on the other side of the support in an amount of 3.5 g/m$^2$ in terms of the coated amount of silver. In order to prepare samples having different swelling percentage of coated film, the amounts of film hardeners in the coated surface protective layer was altered. The designations of the samples thus-prepared, the emulsions used and the swelling percentage employed are shown in Table 1.

TABLE 1

| Samples | Emulsion | Swelling Percentage (%) |
|---|---|---|
| a-1 | A | 100 |
| a-2 | A | 160 |
| a-3 | A | 230 |
| b | B | 130 |
| c | C | 120 |
| d | D | 115 |
| e | E | 110 |

(8) Method for Measurement of Swelling Percentage a) A coated sample was subjected to incubation treatment at a temperature of 38° C. and a relative humidity of 50%.

b) The thickness of the layer was measured.

c) The sample was dipped in distilled water at 21° C. for 3 minutes.

d) The thickness of the layer thus wet was compared to that of the layer measured at step b) to obtain the percentage of the change in the thickness of the layer.

(9) Normal Sensitometry

The seven samples prepared in (7) were stored at a temperature of 25° C. and a relative humidity of 65% for 7 days after coating. These samples were then subjected to scanning-exposure to light of 780 nm wavelength from a semiconductor laser at room temperature for $10^{-7}$ second. These samples thus exposed were developed by Processings I and II described below.

Processing I

Preparation of Developing Solution (38 liters)

| | |
|---|---|
| Part A: | |
| Potassium Hydroxide | 1,107 g |
| Potassium Sulfite | 1,680 g |
| Sodium Hydrogencarbonate | 285 g |
| Boric Acid | 38 g |
| Diethylene Glycol | 456 g |
| Ethylenediaminetetraacetic Acid | 63.5 g |
| 5-Methylbenzotriazole | 2.28 g |
| Hydroquinone | 1,140 g |
| Water to make | 9.50 l |
| Part B: | |
| Glacial Acetic Acid | 416.5 g |
| Diethylene Glycol | 644.5 g |
| 5-Nitroindazole | 9.5 g |
| 1-Phenyl-3-pyrazolidone | 57 g |
| Part C: | |
| Glutaraldehyde | 187.3 g |
| Sodium Metabisulfite | 478.8 g |
| Water to make | 950 ml |
| Starter: | |
| Acetic Acid | 270 g |
| Potassium Bromide | 300 g |
| Water to make | 1.5 l |

Preparation of Developing Solution 20 liters of water was placed in an about 50-liter supply stock tank for the replenisher. Part A, Part B and Part C were sequentially added to the water in the stock tank while stirring. Water was then added to make 38 liters. As a result, a replenisher for a developing solution was obtained (pH 10.30).

The above-described starter was added to the replenisher for developing solution in a proportion of 20 ml/l (developer replenisher) to prepare a developing solution. The developing solution thus-prepared was first placed in the development tank of the automatic developing machine (pH 10.15). Every time the light-sensitive material was processed, the developing solution was replenished in an amount of 60 ml per 1 sheet of B4 size light-sensitive material (25.7 cm×36.4 cm).

Preparation of Fixing Solution (38 liters)

| | |
|---|---|
| Part A: | |
| Ammonium Thiosulfate (70 wt/vol %) | 7.6 l |
| Disodium Ethylenediaminetetraacetate (dihydrate) | 0.76 g |
| Sodium Sulfite | 570 g |
| Boric Acid | 380 g |
| Sodium Hydroxide | 254.6 g |
| Acetic Acid | 570 g |
| Water to make | 9.5 l |
| Part B: | |
| Aluminum Sulfate | 380 g |
| Sulfuric Acid | 148.2 g |
| Water to make | 1.9 l |

Part B:

Preparation of Fixing Solution 20 liters of water was placed in an about 50-liter supply stock tank for the replenisher. Part A and Part B were sequentially added to the water in the stock tank while stirring. Water was then added to make 38 liters so that the replenisher for fixing solution was obtained.

The replenisher for fixing solution was placed in the fixing tank (pH 4.25). Every time the light-sensitive material was processed, the replenisher for fixing solution was replenished in an amount of 60 ml/B4 size sheet of light-sensitive material (25.7 cm×36.4 cm).

Various processing steps were carried out as follows (dry-to-dry time: 96 seconds).

Processing I

| | Volume of Processing Tank | Processing Temperature (°C.) × Processing Time (second) |
|---|---|---|
| Development | 11.5 l | 35° C. × 25 seconds |
| Fixing | " | 35° C. × 20 seconds |
| Rinsing | " | 20° C. × 15 seconds |
| Drying | — | 60° C. |

Processing II

The composition of the concentrated developing and fixing solutions were as follows:

| | |
|---|---|
| Concentrated Developing Solution: | |
| Potassium Hydroxide | 56.6 g |
| Sodium Sulfite | 200 g |
| Diethylenetriaminepentaacetic Acid | 6.7 g |
| Potassium Carbonate | 16.7 g |
| Boric Acid | 10 g |
| Hydroquinone | 83.3 g |
| Diethylene Glycol | 40 g |
| 4-Hydroxymethyl-4-methyl-1-phenyl-3-pyrazolidone (Compound 3 of the present invention) | 5.5 g |
| 5-Methylbenzotriazole | 2 g |
| Water to make | 1 l |
| pH | 10.50 |
| Replenisher Kit Size | 5 l |
| Concentrated Fixing Solution: | |
| Ammonium Thiosulfate | 560 g |
| Sodium Sulfite | 60 g |
| Disodium Ethylenediaminetetraacetate (dihydrate) | 0.10 g |
| Sodium Hydroxide | 24 g |
| Water to make | 1 l |
| Acetic acid to adjust to | pH 5.10 |
| Replenisher Kit Size | 5 l |

Water Stock Tank Liquid:

Disodium Ethylenediaminetetraacetate (dihydrate): 0.5 g/l

Automatic Developing Machine, Dry-to-Dry Time: 60 seconds

Developing Tank (1): 7.5 l, 35° C.×11.5 seconds

Fixing Tank (2): 6.5 l, 35° C.×12.5 seconds

Washing Tank (3): 6.5 l, 20° C.×7.5 seconds

Squeezee Roller Cleaning Tank (7): 200 ml

Water Stock Tank (4): 25 l

Drying: 60° C.

In order to maintain the developing solution and the fixing tank at the predetermined temperature, a heater was used, but no cooling water was used.

When the development was started, the various tanks were filled with the processing solutions described below.

Development Tank:

667 ml of water and 10 ml of an aqueous solution containing 2 g of potassium bromide and 1.8 g of acetic acid were added to 333 ml of the above-described concentrated developing solution (pH 10.15).

Fixing Tank:

250 ml of the above-described concentrated fixing solution and 750 ml of water

Washing Tank and Cleaning Tank:

Solution having the same composition as the above-described water stock tank solution Every time one sheet of the above-described B4 size light-sensitive material (25.7 cm×36.4 cm) was processed, the development tank was replenished with 20 ml of the concentrated developing solution and 40 ml of the stock tank water, the fixing tank was replenished with 10 ml of the concentrated fixing solution and 30 ml of the stock tank water, and the washing tank was replenished with 60 ml of the stock tank water from the squeezee roller cleaning tank in the direction opposite to that of the film. The running processing was continued. During this period, when either of the developing solution, fixing solution, and water ran out of stock, they were similarly replenished.

The results are shown in Table 2.

TABLE 2

| | | | Processing I (Comparison) | | | | | Processing II (Invention) | | | | |
|---|---|---|---|---|---|---|---|---|---|---|---|---|
| Simplicity of solution preparation | | | Complicated due to composition of 3-component system of developing solution and 2-component system of fixing solution | | | | | Simple due to composition of 1-component (a single solution) of developing solution and 1-component (a single solution) of fixing solution and automatic dilution | | | | |
| Space required | | | Large space replenisher tank | | | | | Small space replenisher tank | | | | |
| Odor | | | Ill smell especially from fixing solution | | | | | Little or no ill smell | | | | |
| Processing time (dry-to-dry) | | | 96 seconds | | | | | 60 seconds | | | | |
| Emulsion | Sample | Halogen Composition | Swelling Percentage (%) | 100 Plane/111 Plane Ratio | $\bar{G}$[1] | Sensitivity[2] | Silver Stain[3] | Drying Characteristics[4] | $\bar{G}$[1] | Sensitivity[2] | Silver Stain[3] | Drying Characteristics[4] |
| A | a-1 (Invention) | AgBr | 100 | 93/7 | 1.51 | 0.98 | Good | Good | 1.55 | 1.00 | Good | Good |
| A | a-2 (Invention) | AgBr | 160 | 93/7 | 2.03 | 1.03 | Good | Good | 1.97 | 1.05 | Good | Good |
| A | a-3 (Comparison) | AgBr | 230 | 93/7 | 2.50 | 1.06 | Good | Good | 2.58 | 1.08 | Good | Bad |
| B | b (Invention) | AgBrCl Br/Cl = 80/20 | 130 | 95/5 | 2.50 | 0.77 | Good | Good | 2.51 | 0.78 | Good | Good |
| C | c (Invention) | AgBrI Br/I = 98/2 | 120 | 91/9 | 1.50 | 1.30 | Good | Good | 1.55 | 1.24 | Good | Good |
| D | d (Invention) | AgBr | 115 | 70/30 | 1.49 | 0.63 | Good | Good | 1.50 | 0.66 | Good | Good |
| E | e (Comparison) | AgBrCl Br/Cl = 30/70 | 110 | 97/3 | 3.20 | 0.52 | Good | Good | 3.10 | 0.55 | Bad | Good |

[1] $\bar{G}$ represents the slope of the line between the point of the logarithm of the exposure giving an optical density of 0.8 and the point of the logarithm of the exposure giving an optical density of 2.0 on the characteristic curve.

[2] The sensitivity is represented by the value of −log E of the exposure E giving a density of fog +0.3 relative to that of Sample a-1 according to the present invention which has been subjected to Processing II defined as 1.0.

[3] The silver stain was determined as follows. In the above running processing experiment, immediately after 200 sheets of the light-sensitive material were subjected to running processing in one day, 1 liter of the developing solution was taken from the developing tank of the automatic developing machine. After the developing solution was allowed to stand for two days, the amount of silver precipitated at the bottom of the container (beaker) was determined. The results were classified into ranks.

[4] The drying characteristics were evaluated in the above running processing.

In items [3] and [4], Good represents practically allowable levels while Bad represents impractical levels.

Table 2 shows that the present processing system-can attain rapid processing, simplified preparation of solutions, smaller space of an automatic developing machine and replenisher tanks, and less odor especially from the fixing solution while not affecting adversely the photographic properties.

The sensitivity increases as the proportion of silver chloride decreases, or the proportion of silver iodide increases. However, if the proportion of silver iodide is too high, the gradation becomes too low, even though a high sensitivity is obtained. Therefore, the maximum allowable proportion of silver iodide is limited.

Referring to silver stain, if the proportion of silver chloride is lowered, the silver stain becomes gradually good. However, the proportion of silver iodide is similarly limited due to the relationship with the development speed. From the standpoint of sensitivity, gradation, silver stain, and development speed, the silver halide composition is limited to the present invention. Furthermore, drying is a key point to processing time in the rapid processing. Drying depends on swelling percentage. As in the present invention, if the swelling percentage is 200% or less, a rapid processing can be attained without hardening the film, i.e., without disadvantages such as ill smells.

EXAMPLE 2

Samples were aged in the concentrated developing solution of Processing II in a sealed polyethylene bottle at a temperature of 50° C. for two weeks. The aged samples were then evaluated for stability of 3-pyrazolidones in an alkali solution. The results are shown in Table 3.

TABLE 3

| 3-Pyrazolidones | Stability (%) |
|---|---|
| 1-Phenyl-3-pyrazolidone* | 39 |
| Above-Described Exemplary Compound 3 | 98 |
| Above-Described Exemplary Compound 11 | 100 |
| Above-Described Exemplary Compound 4 | 100 |
| Above-Described Exemplary Compound 9 | 98 |

*The conventional compound, 1-phenyl-3-pyrazolidone does not occur stability in an alkali.

Table 3 shows that even if a simplified processing system according to the present invention is accomplished with a one component developing solution (i.e., a single developing solution), the objects of the present invention cannot be attained unless the 3-pyrazolidones are limited to those of the formula (I) of the present invention.

In accordance with the present invention, a rapid development can provide an image having a high sensitivity in the processing of a silver halide photographic material for infrared laser scanners using means of an automatic developing machine.

Furthermore, the reduction of development time or drying time enables a rapid processing, making it possible to provide a smaller automatic developing machine.

In the present invention, even if the developing solution is a developing solution consisting of one solution containing a specific 3-pyrazolidone developing agent, the photographic properties can be maintained sufficiently high, the preparation of solutions or maintenance of the automatic developing machine can be facilitated, and the simplification and reduction of the automatic developing machine are enabled.

Moreover, less odor is generated in the working environment of the development. And less harmful gas is generated. This can inhibit the corrosion of machines.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material for infrared laser scanner comprising developing said silver halide photographic material which comprises a support having thereon at least one hydrophilic colloidal layer including at least one silver halide emulsion layer which is spectrally sensitized to infrared rays with an automatic developing machine, wherein said silver halide emulsion layer contains silver chloroiodobromide grains having a silver iodide content of 0 to 2 mol %, a silver chloride content of 0 to 30 mol %, an average grain diameter of 0.2 to 0.7 μm, and a ratio of the 100 plane to the 111 plane of 4 or more, said hydrophilic colloidal layer has a swelling percentage of 200% or less, as a developing solution for the development step in said automatic developing machine, a single developing solution containing a 3-pyrazolidone developing agent represented by formula (I) is used therein, and the developing solution and the replenishing solution thereof contain no glutaraldehyde hardening agent:

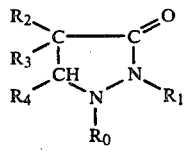

(I)

wherein $R_0$ represents a substituted or unsubstituted aryl group; and $R_1$, $R_2$, $R_3$ and $R_4$, which may be the same or different, each represents a hydrogen atom, a substituted or unsubstituted alkyl group, a substituted or unsubstituted aryl group, or a substituted or unsubstituted aralkyl group, with the proviso that when $R_0$ represents an unsubstituted phenyl group, at least one of $R_1$, $R_2$, $R_3$ and $R_4$ represents a substituted or unsubstituted alkyl group, a substituted or unsubstituted aryl group, or a substituted or unsubstituted aralkyl group.

2. A method for processing a silver halide photographic material as claimed in claim 1, wherein the swelling percentage is from 30% to 180%.

3. A method for processing a silver halide photographic material as claimed in claim 1, wherein the silver chloroiodobromide grains have a silver iodide content of 0 to 0.5 mol % and a silver chloride content of 0 to 20 mol %.

4. A method for processing a silver halide photographic material as claimed in claim 1, wherein the silver chloroiodobromide grains having the ratio of the 100 plane to the 111 plane of 4 or more are contained in an amount of 50 wt % or more of the total silver chloroiodobromide grains.

5. A method for processing a silver halide photographic material as claimed in claim 4, wherein the silver chloroiodobromide grains having the ratio of the 100 plane to the 111 plane of 4 or more are contained in an amount of 60 wt % or more of the total silver chloroiodobromide grains.

6. The method for processing a silver halide photographic material as claimed in claim 1, wherein said at least one silver halide emulsion layer is spectrally sensitized with at least one infrared sensitizing dye selected from the group consisting of tricarbocyanine dyes and 4-quinoline nucleus containing dicarbocyanine dyes.

7. The method for processing a silver halide photographic material as claimed in claim 1, wherein said silver halide photographic material is processed using a fixer having a pH of 4.5 or higher after developed.

8. A method for processing a silver halide photographic material as claimed in claim 1, wherein prior to developing the silver halide photographic material the same is imagewise scanned with an infrared laser scanner.

* * * * *